US006349555B1

(12) United States Patent
Barros et al.

(10) Patent No.: US 6,349,555 B1
(45) Date of Patent: Feb. 26, 2002

(54) TURBULENCE INDUCER FOR CONDENSATE SUB-COOLING COIL

(75) Inventors: Daniel Alessandro Oliveira de Barros, Novo Hamburgo; Gilberto Fagundez de Souza, Porto Alegre; Luciano da Luz Moraes, Canoas; Paulo Augusto Lisboa Ramos, Esteio, all of (BR)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 09/743,541

(22) PCT Filed: May 28, 1999

(86) PCT No.: PCT/BR99/00038

§ 371 Date: Mar. 22, 2001

§ 102(e) Date: Mar. 22, 2001

(87) PCT Pub. No.: WO00/73710

PCT Pub. Date: Dec. 7, 2000

(51) Int. Cl.[7] ..... F25D 23/12; F25B 47/00
(52) U.S. Cl. ..... 62/262; 62/279; 62/280
(58) Field of Search ..... 62/262, 279, 280, 62/285

(56) References Cited

U.S. PATENT DOCUMENTS 2,961,843 A * 11/1960 McMillan et al. ..... 62/280
3,763,660 A * 10/1973 Burney ..... 62/280
3,996,764 A 12/1976 Gilmer et al. ..... 62/279
4,766,738 A * 8/1988 Ebata ..... 62/280
5,327,743 A 7/1994 Coltrin ..... 62/279
5,682,757 A 11/1997 Peterson ..... 62/259

FOREIGN PATENT DOCUMENTS

FR 2552862 5/1985

* cited by examiner

*Primary Examiner*—William C. Doerrler

(57) ABSTRACT

An orifice member for the condenser fan of an air conditioning unit which has a basepan and partition dividing the unit into an indoor section forward or the partition and an outdoor section behind the portion. The wall section has at least one through opening therein laterally spaced from the centerline of the orifice and in close proximity to the basepan. The opening communicates the region of the basepan on the high pressure side of the wall section with the low pressure side region of the basepan, which contains the sub-cooling coil. The opening is located and configured such that when the air conditioner is operating and condensate has collected in the basepan, condensate will be pumped through the opening from the high pressure side to the low pressure side and thereby cause turbulence in the condensate in the region of the basepan which contains the sub-cooling coil.

6 Claims, 4 Drawing Sheets

TURBULENCE INDUCER FOR CONDENSATE SUB-COOLING COIL

TECHNICAL FIELD

This invention relates to room air conditioners and is more specifically directed to the configuration of a condenser coil fan orifice to pump collected condensate into the region of a sub-cooling coil located in the basepan of the air conditioner.

BACKGROUND ART

In air conditioning systems, condensation normally collects on the evaporator coil, runs off and must be disposed of. In room air conditioners, it is common to direct the condensate through various passageways to the outdoor section of the air conditioner where the compressor, condenser coil and condenser fan are located. When the air conditioner has been in operation for some time, a pool of condensate will collect in the outdoor section of the basepan. Several ways are known for dealing with the collected condensate in order to improve condenser capacity and the energy efficiency rating (EER) of the air conditioning unit. One of these is to provide a slinger arrangement associated with the condenser fan. In a typical slinger arrangement, a blow-through propeller fan coil configuration is used and the condensate collects at a location where the fan structure causes the condensate to be splashed onto the condenser coil where it is evaporated thereby, providing cooling to the condenser. Such slingers are typically located at the fan blade tips on the discharge (high pressure) side of the fan.

The propeller fan is typically surrounded by a condenser fan shroud, which divides the outdoor section into the previously mentioned high pressure side and the low pressure side, which is on the intake side of the condenser fan and in which the fan motor and compressor are located. A second way of utilizing the collected condensate to improve the efficiency of the air conditioning unit is to provide a sub-cooling coil in the basepan of the outdoor section in the low pressure side thereof. When the unit is in operation, this region of the basepan has a collection of condensate therein and the sub-cooling coil is configured to be at least partially immersed in the condensate, thus, promoting further cooling of the liquid refrigerant passing from the condenser coil to the expansion device of the air conditioning unit and thence to the evaporator coil. Designers of air conditioning units are always looking for additional ways in which to enhance the overall energy efficiency of the unit.

DISCLOSURE OF THE INVENTION

An orifice member for a the condenser fan of an air conditioning unit, which has a basepan and partition dividing the unit into an indoor section forwardly of the partition and an outdoor section rearwardly of the partition. The indoor section includes an evaporator coil, an evaporator fan and means for collecting condensate and directing the condensate to the basepan in the outdoor section. The outdoor section includes a condenser coil at the rear thereof, a condenser fan having a suction side and a discharge side, which is located forwardly of the condenser coil, and a compressor. The compressor, condenser and evaporator are connected in a closed refrigeration circuit, which includes a refrigerant line between the discharge of the condenser and the inlet to the evaporator, which includes, serially arranged therein, a sub-cooling coil and an expansion device. The orifice defines a barrier between the suction side and the discharge side of the condenser fan and includes a fan orifice opening therein generally forwardly of the fan to define a restricted air flow passage therethrough between the suction side at a low pressure and the discharge side at a high pressure. The sub-cooling coil is located in the region of the basepan in the outdoor section forwardly of the orifice member and in close proximity thereto. The region of the basepan in which the sub-cooling coil is located is configured to collect condensate. The orifice member has a wall section underlying the fan orifice opening. The wall section has at least one through opening therein laterally spaced from the centerline of the orifice and in close proximity to the basepan. The opening communicates the region of the basepan on the high pressure side of the wall section with the low pressure side region of the basepan, which contains the sub-cooling coil. The opening is located and configured such that when the air conditioner is operating and condensate has collected in the basepan, condensate will be pumped through the opening from the high pressure side to the low pressure side and thereby cause turbulence in the condensate in the region of the basepan, which contains the sub-cooling coil.

BRIEF DESCRIPTION OF THE DRAWINGS

The invention may be better understood and its objects and advantages will become apparent to those skilled in the art by reference to the accompanying drawings, in which.

BEST MODE FOR CARRYING OUT THE INVENTION AND INDUSTRIAL APPLICABILITY

Figures 1, 2:
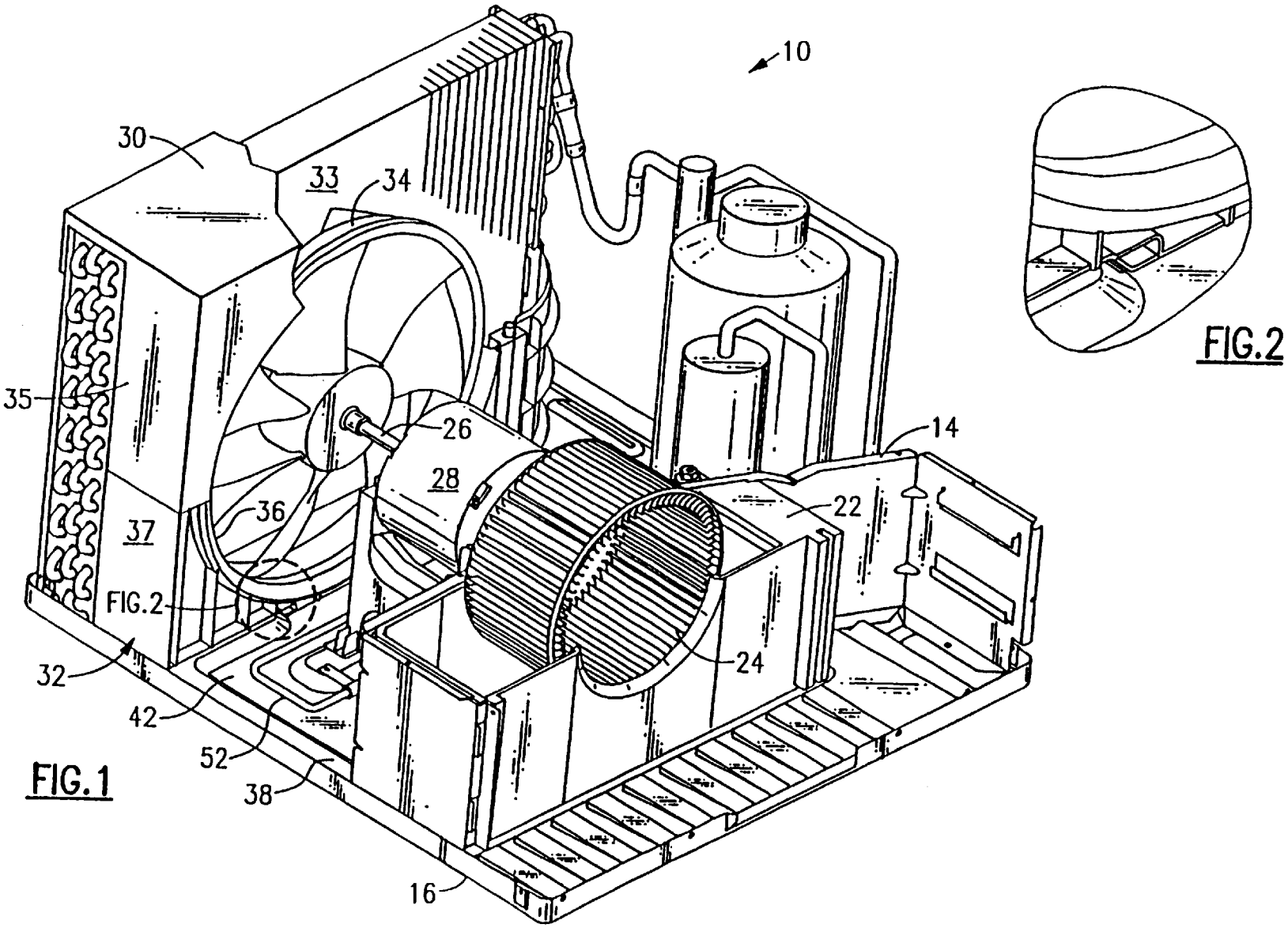
FIG. 1 is a front perspective view of an air conditioning unit embodying the present invention, which has a number of components removed therefrom.
FIG. 2 is an enlarged view of a portion of FIG. 1.
Figure 3:
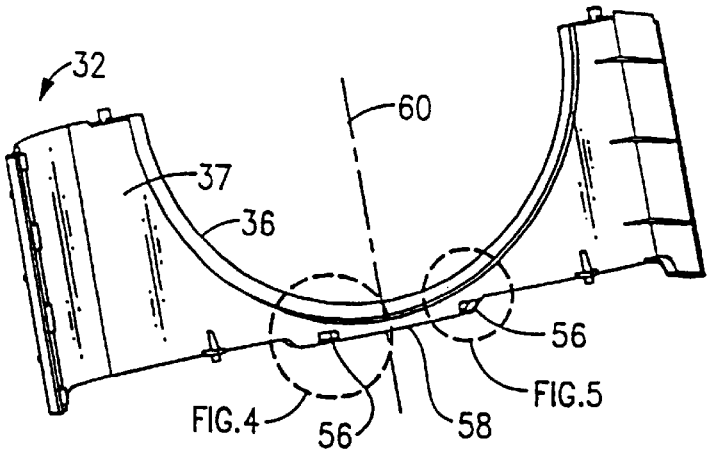
FIG. 3 is a rear view of condenser fan shroud embodying the present invention.
Figure 4:
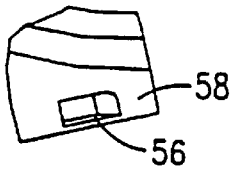
FIG. 4 is an enlarged view of a portion of FIG. 3.
Figure 5:
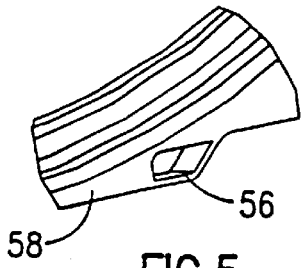
FIG. 5 is an enlarged view of another portion of FIG. 3.
Figure 6:
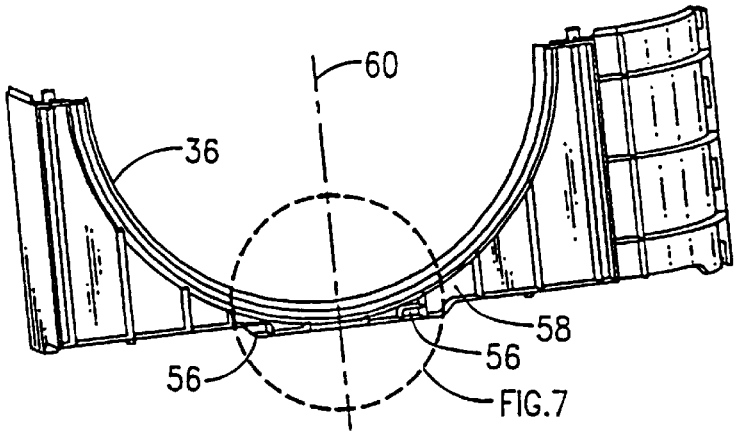
FIG. 6 is a perspective view of the front of the condenser fan shroud illustrated in FIG. 3.
Figure 7:
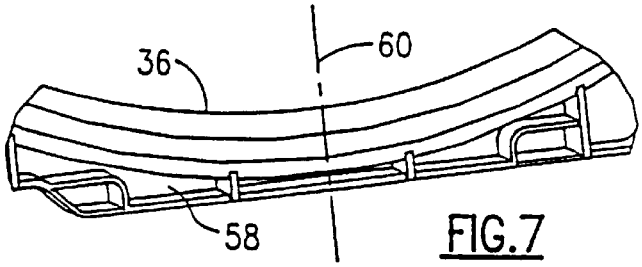
FIG. 7 is an enlarged view of a portion of FIG. 6.
Figure 8:
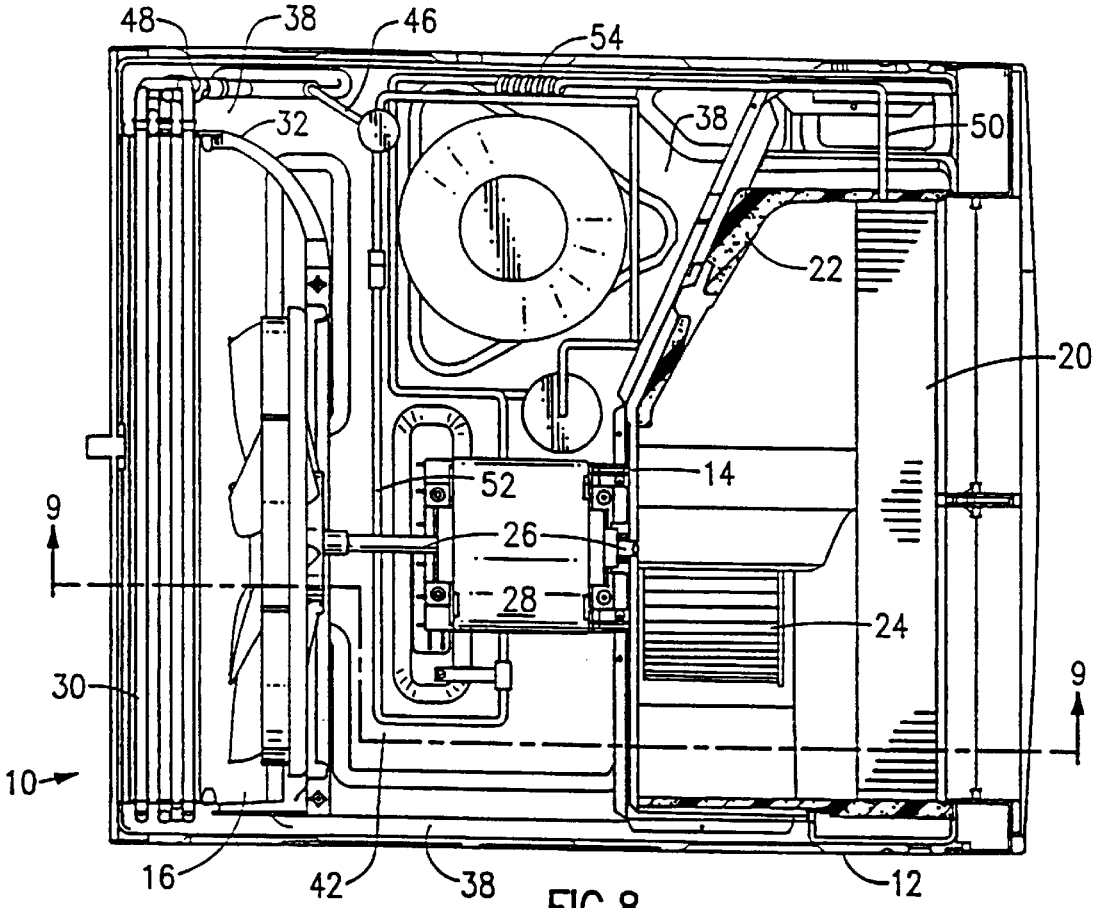
FIG. 8 is a top view of an air conditioner embodying the present invention.
Figure 9:
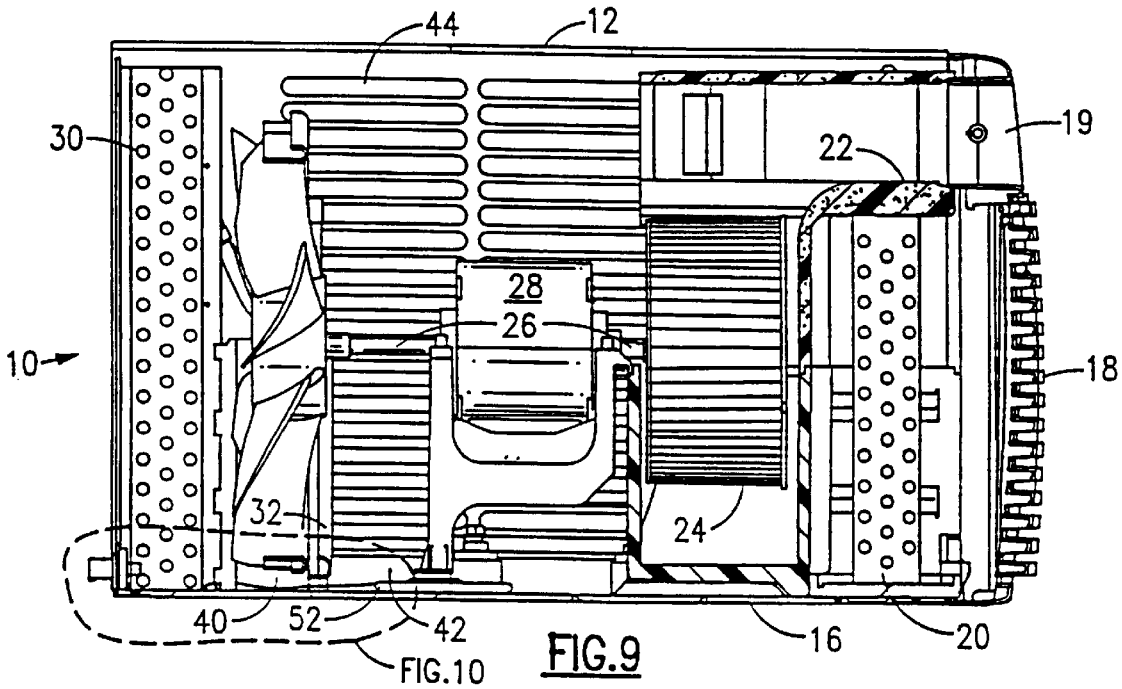
FIG. 9 is a view of the air conditioner unit of FIG. 8 taken along the line 9—9 thereof.

In FIGS. 1, 8 and 9, the number 10 generally designates a room air conditioner employing the present invention. As is conventional, the room air conditioner 10 has a housing 12, which may be located in a window or through a wall sleeve. The housing 12 is divided by partition or barrier 14 into an evaporator or inside section and a condenser or outside section, which are each, in turn, divided into a suction and discharge section relative to the fans located therein. All of the components of the indoor and outdoor section are supported in a structural basepan 16. The housing 12 includes inlet grille 18, which, when air conditioner 10 is installed, faces the interior of a room to be cooled. An evaporator coil 20 is located directly behind inlet grille 18 and is mounted within an air directing scroll 22 in which an evaporator fan 24 is disposed. The fan 24 is driven by motor 28 via shaft 26, which passes through and is sealingly supported by the partition 14. The evaporator fan 24 directs air into the room to be cooled via louvers 19. A condenser coil 30 is located in housing 12 with its discharge side facing the outside. A shroud 32 is connected to condenser 30 and the interior of housing 12 such that a fan chamber 33 containing the moving portion of a condenser fan 34 is formed. A shroud 32 includes an inlet orifice 36. Fan 34 is of the axial, shrouded propeller type and is located entirely in the fan chamber 33 and is connected to motor 28 via shaft 26 such that both of fans 24 and 34 are commonly driven.

It will be noted in FIG. 1 that the shroud 32 is formed from a lower piece 35, which is shown in its entirety and an upper piece 37, which is only partially shown in the drawing figure. The upper part and lower part 35, 37 of the shroud each contain a semi-circular opening therein, which cooperates to define the above-described inlet orifice 36 of the shroud 32.

In operation, motor 28 commonly drives evaporator fan 24 and condenser fan 34. Evaporator fan 24 draws air from the room to be cooled with the air serially passing through inlet grille 18, evaporator 20 which causes the air to be cooled, fan 24 and outlet louvers 19 back into the room. In cooling the air during its passage through evaporator 20, condensate commonly forms and falls to the lower end thereof where it is collected and directed in a known manner through the barrier or partition 14 and into channels 38, which conduct the condensate of the basepan 16 on both inlet and suction sides of the condenser fan shroud 32. As a result of such flow, condensate collects both in the region 40 rearwardly of the condenser shroud 32 and in the region 42 forwardly of the condenser shroud. Condenser fan 34 draws outside air into the housing 12 via inlet openings 44 in the housing and the air serially passes through the fan 34, through the inlet orifice 36, and through condenser 30 rejecting heat from the condenser.

The refrigeration circuit of the room air conditioner 10 includes a refrigerant line 46, which communicates the discharge 48 of the condenser coil 30 with the inlet 50 of the evaporator 20. Located in this line 46 is a sub-cooling coil 52, which extends from the condenser discharge 48 and forms a loop of copper tubing in the basepan forwardly of the condenser shroud in the region 42 in which condensate is collected. From the sub-cooling coil refrigerant passes to an expansion device 54, which, in turn feeds cooled, condensed liquid refrigerant to the evaporator, as is conventional.

Accordingly, during operation of the air conditioner, hot liquid refrigerant passing from the condenser 30 passes through the sub-cooling coil 52 where its temperature is reduced below the condensing temperature prior to passing through the expansion device 54 and thence to the evaporator thereby increasing the efficiency of the air conditioner. The temperature in the sub-cooling coil 52 may be even further reduced when liquid condensate has accumulated in the region 42 thus immersing the sub-cooling coil 52 in water.

Figure 10:
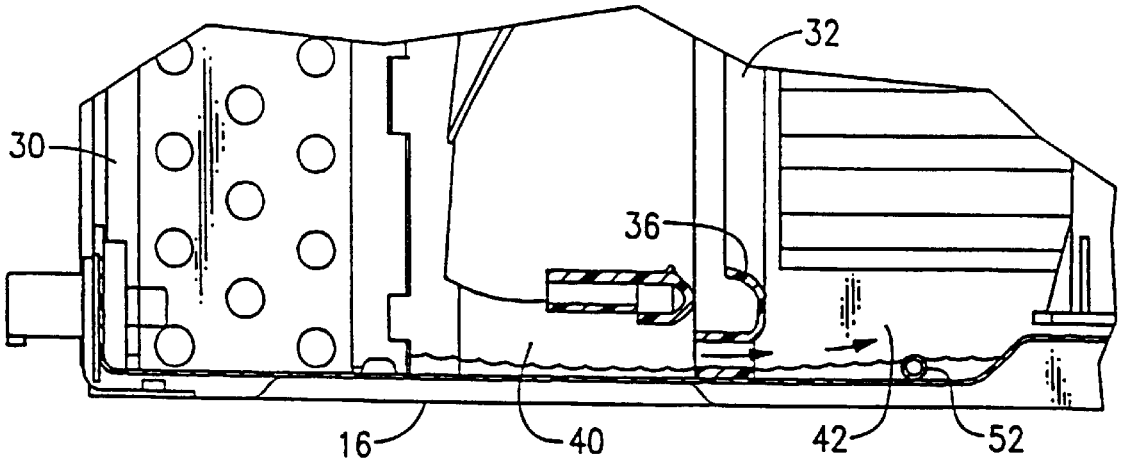
FIG. 10 is an enlarged view of a portion of FIG. 9.

As best shown in FIGS. 3 through 7, a pair of through openings 56 have been provided in the portion 58 of the condenser shroud wall, which underlies the inlet orifice 36. It should be noted that each of the openings 56 is spaced laterally from the centerline 60 of the inlet orifice 36. It has been found that by positioning these openings laterally from the centerline 60 of the orifice by a sufficient distance that the pressure differential across the condenser shroud 32, as described above, will result in the pumping of air and/or water through the orifices 56 in the direction illustrated by the arrows in FIG. 10 to thereby cause turbulence in the condensate collected in the region 42 in which the sub-cooling coil 52 is located. Such turbulence has been found to increase the sub-cooling from approximately four degrees (4°) centigrade up to approximately four and one-half (4.5°) centigrade, an increase in excess of ten percent (10%).

In the illustrated embodiment, the inlet orifice 36 is approximately thirty-eight (38) centimeters in diameter and the two openings 56 are each spaced from the centerline of the inlet orifice 36 by approximately five (5) centimeters to either side of the centerline. Such distance being measured from the centerline to the nearest edge of the openings 56. It has been found that a centrally located orifice, which is known in the art, for purposes of allowing condensate flow in the opposite direction will not produce the same result. It should be appreciated that a distance of openings from the centerline of the orifice to achieve the optimum results will vary depending upon the size of the air conditioner and the resulting size of the inlet orifice and the fan, as well as other variables.

It will be noted that the openings 56 illustrated in the preferred embodiment are substantially elongated having their longest dimension extending horizontally and parallel to the basepan 16. Each of the openings illustrates is approximately one and one-sixth (1.6) centimeters long and approximately one-eighth (0.8) centimeters in height. This ratio of approximately two to one/length to width has been found to provide effective flow for inducing the desired turbulence.

While the lateral location of the openings 56 has been shown and described with this preferred embodiment, it has been found that lateral locations ranging from a distance of five percent (5%) to twenty-five percent (25%) of the diameter of the inlet orifice will provide pumping, openings located within ten percent (10%) to twenty percent (20%) of the orifice diameter provide closer to optimum pumping/turbulence. It should be noted that in the preferred embodiment the lateral spacing is approximately thirteen percent (13%) of the inlet orifice diameter.

What is claimed is:

1. An orifice member for the condenser fan of an air conditioning unit, the air conditioning unit having a basepan, the basepan having a partition extending vertically therefrom which divides the air conditioning unit into an indoor section forwardly of the partition and an outdoor section rearwardly of the partition, the indoor section including an evaporator coil, an evaporator fan, and means for collecting condensate and directing the condensate to the basepan in the outdoor section, the outdoor section including a condenser coil at the rear thereof, a condenser fan having a suction side and a discharge side, the fan being located forwardly of the condenser coil, and a compressor, the compressor, condenser and evaporator being connected in a closed refrigeration circuit, which includes a refrigerant line between the discharge of the condenser coil and the inlet to the evaporator, the refrigerant line having, serially arranged therein, a sub-cooling coil and an expansion device, the orifice member defining a barrier between the suction side and the discharge side of the condenser fan and having a fan orifice opening therein generally forwardly of the fan to define a restricted air flow passage therethrough between the suction side at a low pressure and the discharge side at a high pressure;

the sub-cooling coil being located in a region of the basepan in the outdoor section forwardly of the orifice member and in close proximity thereto, wherein the improvement comprises:

said region of the basepan in which said sub-cooling coil is located is configured to collect condensate therein;

said orifice member having a wall section underlying said fan orifice opening, said fan orifice opening having an imaginary vertically extending centerline, said wall section having at least one through opening therein in close proximity to said basepan and spaced from said centerline by a predetermined distance, said at least one through opening communicating the region of said basepan on the high pressure discharge side of said wall section with the low pressure suction side region of said basepan, which contains said sub-cooling coil;

said at least one through opening being configured and said predetermined distance being selected, such that, when said air conditioning unit is operating and condensate has collected in said basepan, condensate will be pumped through said at least one through opening from said high pressure side to said low pressure side and thereby cause turbulence in said condensate in the region of said basepan, which contains said sub-cooling coil.

2. The apparatus of claim 1 wherein said fan orifice opening is substantially circular and has a diameter, and wherein said predetermined distance is measured horizontally from said centerline to the nearest edge of said opening, and wherein said predetermined distance is between five percent (5%) to twenty-five percent (25%) of said diameter.

3. The apparatus of claim 2 wherein said at least one through opening comprises a first opening on one side of said centerline and a second opening on the other side of said centerline, both of said openings being positioned said predetermined distance from said centerline.

4. The apparatus of claim 3 wherein said predetermined distance is between ten percent (10%) to twenty percent (20%) of said diameter.

5. The apparatus of claim 4 wherein each of said through openings has an elongated cross-section, with the longest dimension thereof extending substantially parallel to said basepan.

6. The apparatus of claim 5 wherein the ratio between the longest dimension and the shorter dimension of each of said through openings is approximately two to one.

* * * * *